United States Patent [19]

Shibata et al.

[11] Patent Number: 4,577,205

[45] Date of Patent: Mar. 18, 1986

[54] RELEASABLE HEAT-SENSITIVE LABEL WITH E. B. SETTING PRINTING INK

[75] Inventors: Tomoo Shibata, Irvine; Wissam J. Jurdi, Anaheim, both of Calif.

[73] Assignee: Ricoh Electronics, Inc., Santa Ana, Calif.

[21] Appl. No.: 614,307

[22] Filed: May 25, 1984

[51] Int. Cl.[4] ..... B41M 5/18

[52] U.S. Cl. ..... 346/204; 346/226; 427/43.1; 427/152; 428/40; 428/201; 428/202; 428/207; 428/354; 428/913; 428/914

[58] Field of Search ..... 106/21; 346/200, 201, 346/204, 226; 427/43.1, 150, 151, 152; 428/40, 201-204, 206, 207, 352, 354, 913, 914

[56] References Cited

U.S. PATENT DOCUMENTS 4,022,926 5/1977 Keough et al. ..... 427/43.1
4,370,370 1/1983 Iwata et al. ..... 427/150
4,388,362 6/1983 Iwata et al. ..... 427/150
4,424,245 1/1984 Maruta et al. ..... 428/913

*Primary Examiner*—Bruce H. Hess
*Attorney, Agent, or Firm*—Walter A. Hackler

[57] ABSTRACT

A thermosensitive recording label includes a substrate, a thermosensitive color-forming layer disposed on one side of said substrate, a protective layer disposed on the thermosensitive color-forming layer, and electron beam setting printing ink disposed in a preselected pattern on the protective layer, a pressure-sensitive adhesive layer disposed on another side of the substrate and a releasing bold backing sheet disposed on the pressure-sensitive adhesive layer. A visible pattern is thereafter created by exposing the thermosensitive recording label to an electron beam to set, or cure the electron beam setting ink. The electron beam setting ink may be printed additionally on the substrate and the backing sheet to enable product coding information to be printed on the substrate as well as the printing of a manufacturer's logo on the backing sheet.

10 Claims, 3 Drawing Figures

RELEASABLE HEAT-SENSITIVE LABEL WITH E. B. SETTING PRINTING INK

The present invention generally relates to thermosensitive recording labels and is more particularly related to thermosensitive recording labels having multiple printings thereon. One printing may include a background pattern, or design, and general information such as measurement terms; "lb.," "kg," "$/lb.," etc., and another printing may include specific characteristics identifying the goods onto which the label is placed; for example, the exact weight and name of the product.

Labels for use in the sale of products have, typically been prepared by printing processes utilizing solvent or water-based printing inks or ink impregnated ribbons.

Traditionally, these printing processes require a separate drying of the ink before contact is made with the printed surface. Otherwise, smearing of the ink may occur.

While the printing of background patterns and general information may be efficiently accomplished with off-site printing processes, the printing of specific characteristics is typically done on-site according to the exact weight and identity of the goods onto which the label is to be applied.

On-site printing, utilizing conventional printing ink and/or ribbons for specific characteristics of the goods, has been found to be unsatisfactory in many applications for the reasons hereinbefore recited; namely, smearing of the ink on the labels due to insufficient drying time.

Another disadvantage associated with ribbon type printing is the inefficient use of the ribbon due to the small percentage of ribbon actually used and the inconvenience of continual change of the printing ribbon.

To overcome these deficiencies, thermosensitive recording type labels have been developed. These labels generally utilize a thermosensitive coloring material comprising a colorless or light-colored leuco dye and an acidic substance capable of causing the leuco dye to undergo color formation upon heating of the thermosensitive recording label.

In general, a layer of thermosensitive coloring material is disposed on a substrate and a thermal head printer is thereafter used to contact and heat specific areas of the layer to cause color formation in the areas heated, while the remainder of the layer stays colorless, thereby producing visible alphanumeric characters in the layer. An adhesive layer is disposed on another side of the substrate and a removable backing sheet disposed thereon which is subsequently stripped off to "stick" the label to goods.

This type of thermosensitive label is well known and generally described in U.S. Pat. No. 4,370,370 issued Jan. 25, 1983.

Since printing on such labels is done with a thermal head printer, separate ink and/or ribbons are not utilized, thus enabling high speed printing without the associated maintenance problems generally accompanying set ink and ribbon printing processes.

Importantly, thermosensitive labels in which a thermal head printer is utilized, essentially eliminates the smearing problems associated with conventional ink printing.

However, such thermosensitive labels introduce yet additional problems. Because such labels are typically placed on plastic wrapped products, such as perishables, contact with plastic wrap from co-mingled products, or packages, is inevitable. When this occurs, degradation of the heat-formed printing begins, as evidenced by fading of the color formed by the leuco dye and acidic substance. This effect is well known, although not thoroughly explained, and is thought to be caused by plasticizers in the plastic sheet.

To inhibit this action, a protective layer is typically coated over the thermosensitive color-forming layer to prevent contact between the thermosensitive color-forming layer and plasticizer containing materials.

As hereinbefore pointed out, thermosensitive recording labels generally have multiple printings thereon, one printing of general information, and a second of specific information, the latter printing being accomplished with a thermal printing head. In general, this printing is done after the thermosensitive recording labels have been produced in a "stock" form, hence, it becomes necessary to print the general information onto the protective layer covering the thermosensitive color-forming layer.

If such printing is done with conventional ink or ribbon printing techniques, smearing of the ink is more likely because of the nature of the thermosensitive color-forming layer and/or protective layer, hence, a drying step may be necessary to set the conventional ink.

This setting, however, is typically done through the application of heat, and this heat has a detrimental effect on the thermosensitive color forming layer, as would be expected.

To overcome this disadvantage, an attempt has been made to utilize ultraviolet (UV) setting type printing ink for the printing of a pattern, or the like, on the protective layer, see U.S. Pat. No. 4,386,362 issued June 14, 1983.

This type of label employs an ultraviolet setting type printing ink consisting essentially of a photopolymerization initiator, a prepolymer, a monomer, and a conventional pigment.

In manufacture, the UV setting type printing ink is printed on the protective layer covering the thermosensitive color-forming layer in a conventional manner, and thereafter exposed to an ultraviolet light source to set, or color, the printed pattern which is induced by the production of a radical by the photo-polymerization initiator when it is exposed to the ultraviolet light.

This UV light setting type of thermosensitive recording adhesive label has a number of disadvantages.

First is the cost of the photo-polymerization initiator which may amount to about twenty five (25) percent of the total cost of the UV setting type printing ink.

Also, the setting of the UV ink is essentially a surface phenomena, with very little penetration of the UV into the ink. Because of this, the density of color formation is limited and a thicker printing of UV ink does not increase the color density.

In addition, the thermosensitive color-forming layer is exposed to the UV light and because of the amount of energy, up to about 148 Kcal/m$^2$, necessary to set the UV ink, heating of the thermosensitive color-forming layer also occurs, which is undesirable.

It is also apparent that because of the limited penetration of ultraviolet light into a surface, the ultraviolet light setting type inks cannot be coated, nor are they useful in the printing of a pattern onto other layers of the label, such as the substrate or backing sheet because no ultraviolet light reaches these lower levels, or layers.

Printing of other layers, such as the substrate or backing sheet, may have advantages in displaying a manufacturers logo, identification number, or a lot number assigned to a particular group of goods to indicate a manufacturing date or the like.

The present invention utilizes an electron beam (EB) setting ink in combination with a thermosensitive color-forming layer and a protective layer thereon to enable the production of a thermosensitive recording label capable of forming visible patterns on the protective layer at a very high speed by curing the EB setting ink with an electron beam.

Complete curing of the electron beam setting ink is rapidly accomplished because of the penetration power of the electron beam into the ink and the label itself. In fact, multiple coatings of such EB setting ink may be accomplished, simultaneously, because of such penetration.

Further, less energy is required to cure, or set, the electron beam setting printing ink, the energy necessary to cure the ink being less than one-half that required to set ultraviolet setting type ink.

SUMMARY OF THE INVENTION

A thermosensitive recording label in accordance with the present invention includes a substrate, a thermosensitive color-forming layer disposed on one side of the substrate, a protective layer disposed on the thermosensitive color-forming layer, an electron beam setting printing ink disposed in a preselected pattern on the protective layer, a pressure-sensitive adhesive layer disposed on another side of the substrate and a releasable backing sheet disposed on the pressure sensitive adhesive layer.

The thermosensitive color-forming layer includes a colorless or light-colored leuco dye and an acidic substance capable of causing the leuco dye to undergo color formation upon heating of the thermosensitive recording label and the electron beam setting printing ink consists essentially of a prepolymer, a monomer and a pigment. Because no photo-polymerization initiator is used, the printing cost of the label, in accordance with the present invention, is significantly lower.

A thermosensitive recording label, in accordance with the present invention, may also include electron beam setting printing ink disposed in a preselected pattern on the substrate and/or the releasable backing sheet.

A method for printing a thermosensitive recording label, in accordance with the present invention, includes the steps of exposing either side of a thermosensitive recording label of the present invention to an electron beam with such exposure being sufficient to set the electron beam setting printing ink and of sufficient energy to penetrate all layers of such electron beam setting ink present in the thermosensitive recording label, thereby simultaneously printing on the label surface and the substrate as well as the backing sheet, if such printing ink is present. Thereafter, the protective layer and the thermosensitive color-forming layer thereunder is contacted with thermal head printer at a sufficient temperature and duration to enable the leuco dye to undergo color formation, thereby causing a second printing on the thermosensitive recording label.

In this manner, a background pattern may be formed on the label without the use of conventional solvent and/or water base inks. This method of printing is extremely fast and requires no drying time as is necessary with such conventional methods. Hence, high printing production rates may be obtained.

In addition, simultaneous patterns may be printed throughout the label which heretofore has been impossible to accomplish. The advantages of such printing include the ability to mark product coding on the substrate of the label which is attached to the product. While not visible when the label is in place on the product, when the label is removed such code identification is readable on the substrate and can aid in product tracing and identification by the manufacturer.

Alternatively, if the label is used on clear or transparent plastic shrink wrap covering the goods, the product coding information may be visible through the plastic shrink wrap after it is removed from the goods.

Additionally, printing on the releasable backing sheet can provide an imprint of the manufacturers logo and the like.

BRIEF DESCRIPTION OF THE DRAWINGS

A better understanding of the present invention may be had from the consideration of the following detailed description, taken in conjunction with the accompanying drawings in which.

DETAILED DESCRIPTION

Figure 1:
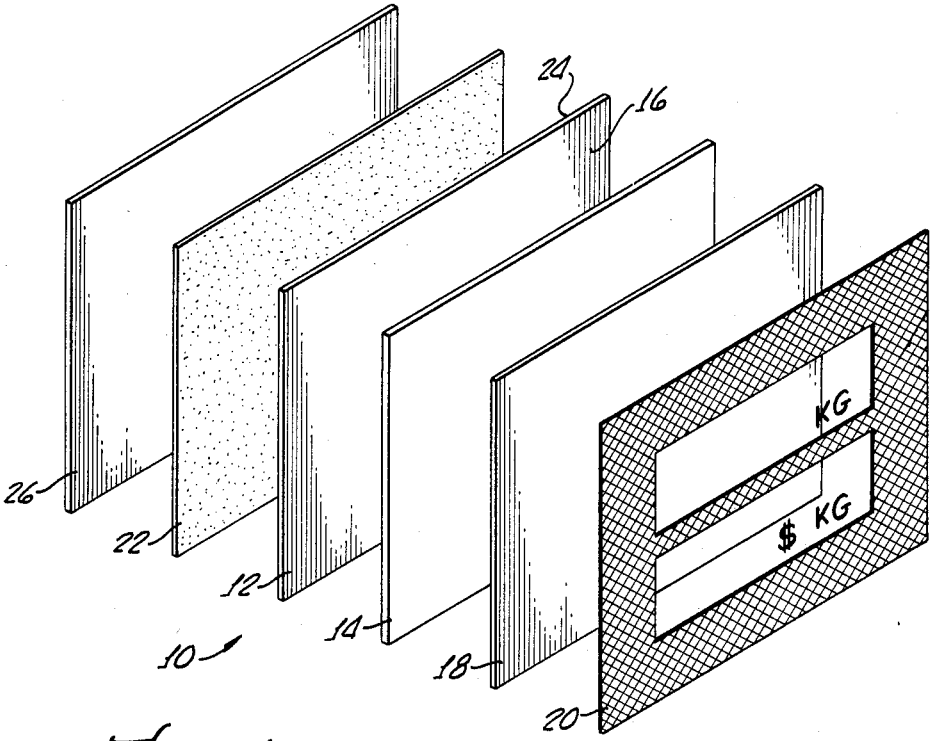
FIG. 1 is a perspective drawing of the thermosensitive recording label, in accordance with the present invention, in an exploded format generally showing each of the layers of the thermosensitive recording label.
Figure 2:
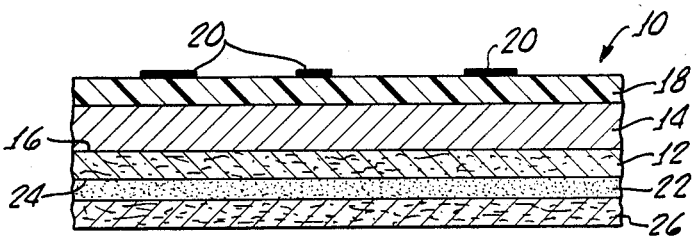
FIG. 2 is a cross-sectional view of the thermosensitive recording label shown in FIG. 1; and, FIG. 3 is an alternative embodiment of the present invention showing a thermosensitive recording label having a plurality of electron beam setting printing ink patterns disposed thereon.
Figure 3:
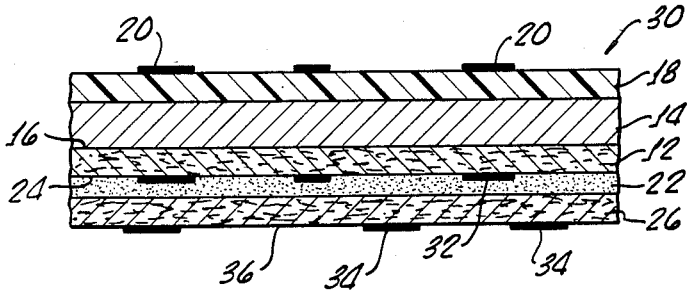

Turning now to FIGS. 1, 2 and 3, the thermosensitive recording label 10 includes a substrate 12, a thermosensitive color-forming layer 14 disposed on one side 16 of the substrate 12, a protective layer 18 disposed on the thermosensitive color-forming layer 14, and electron beam (EB) setting printing ink 20 disposed in a preselected pattern on the protective layer 18.

Also generally part of the thermosensitive recording label 10 is a pressure-sensitive adhesive layer 22, disposed on another side 24 of the substrate 12 and a releasable backing sheet 26 disposed on the pressure-sensitive adhesive layer 22.

In general, the substrate 12 may be a common high quality paper and the thermosensitive recording color-forming layer 14 is typical of that known in the art as shown in U.S. Pat. Nos. 4,370,370 and 4,388,382, and examples of the colorless or light-colored leuco dye and the acidic substances are given therein.

Additionally, as pointed out in U.S. Pat. No. 4,388,362 enhancers may be included in the thermosensitive color-forming layer in order to enhance the distinctiveness of the color images. Such enhancers may include fine powders of calcium carbonate, magnesium carbonate, alumina, silica, talc, barium sulfate, aluminum sterate, styrene resin, urea-formalin resin or the like.

Finally, binder agents may be utilized in the thermosensitive color-forming layer as is well known in the art.

A water soluble resin solution coated on the thermosensitive color-forming layer and thereafter dried, forms the protective layer 18. A number of water soluble resins may be utilized and the thickness of the protective layer 18 controlled, as is well known in the art, to prevent subsequent deterioration of the thermosensitive color-forming layer by plasticizers contained in plastic, which may be placed on, or come in contact with the thermosensitive recording label 10. The preselected pattern 20 is thereafter printed on the protective layer 18 with an EB setting printing ink which is thereafter exposed to EB radiation to form a visible printed pattern on the thermosensitive recording label.

The electron beam setting printing ink consists essentially of a prepolymer, a monomer and a pigment. Although similar to ultraviolet setting printing inks, EB setting printing ink is distinguished in that it does not require any photo-polymerization initiators, and hence, is significantly less expensive. Generally, examples of the prepolymer utilized in the EB setting printing ink may be unsaturated polyesters, vinyloxyethylacrylate, urethane-acrylates, epoxy-acrylates, dicyclopentadiene acrylates and the like.

The monomer may be acrylic acid esters, methacrylic acid esters, aryl compounds, styrene and the like, and the pigment may be the same used in conventional type printing inks. Specifically, the monomer may be ethylene glycol diacrylate, 1, 6-hexanediol diacrylate, bisphenol A-diglycidyl ether or dipentaerythritol hexacrylate and the like.

Following the printing of the EB setting printing ink onto the protective layer 18, the label may be exposed to EB radiation to form the printed pattern.

Continuing, a pressure-sensitive adhesive layer 22 is formed on another side 24 of the substrate 12 as is well known in the art, which is thereafter covered with the releasable backing sheet 26.

Silicone coating may be placed on releasable backing sheet and/or the substrate surface 24 treated in a manner such that the pressure-sensitive adhesive layer 22 remains on the substrate surface 24 when the releasable backing sheet 26 is removed or peeled therefrom to enable the thermosensitive recording label to be fixed to goods.

Alternatively, the pressure-sensitive layer 22 may be formed on the backing sheet and thereafter applied to the substrate. The relative adhesion between the substrate and the adhesive and the backing sheet and the adhesive is controlled so that after the adhesive and backing sheet 26 are laminated to the substrate, the backing sheet may be removed or stripped, leaving the adhesive layer 22 on the substrate 12.

A great number of pressure-sensitive adhesives may be used as well as releasable backing sheets, all of which are well known in the art.

Turning now to FIG. 3, there is shown an alternate embodiment 30 of the present invention utilizing a plurality of EB setting printing ink patterns 20, 32, 34 disposed within a thermosensitive recording label, in accordance with the present invention.

Similar reference characters in FIG. 3 relate to and identify the same elements as shown in FIG. 2.

The thermosensitive recording label 30 depicted in FIG. 3 includes an electron beam setting ink disposed in a preselected pattern 32 on the back side 24 of the substrate 12 as well as electron beam printing ink disposed on a preselected pattern 34 on a back side 36 of the releasable backing sheet 26.

The printing of the EB setting printing ink on the back side 24 of the substrate 12 may be done at any convenient time during the manufacture of the thermosensitive recording label. That is, it may be a first step, or it may be applied, if convenient, after the thermosensitive color-forming layer 12, the protective layer 18 and the EB setting printing ink pattern 20 have been applied.

Following the printing of the pattern 32 on the substrate 12, the pressure-sensitive adhesive layer and backing sheet 26 may be laminated thereto in a conventional manner as hereinabove described.

Printing of the EB setting printing ink pattern 34 on the releasable backing sheet may occur before or after it is applied to the adhesive layer as may be convenient.

Advantages of this multiple EB setting printing ink patterns are numerous. First, as to the pattern 32 printed on the substrate, this printing may include coded information as to the product manufacture date, lot number, etc., which is otherwise not visible to the buyer of goods. But, with proper selection of adhesive layer 22, the thermosensitive recording label 30 may be removed from the goods thereby exposing a printed pattern 32 and the coded information.

Alternatively, if the label is used on clear or transparent plastic shrink wrap covering the goods, the product coding information may be visible through the plastic shrink wrap after it is removed from the goods.

The printing 34 on the releasable backing sheet is useful in providing a company logo or trademark for identifying the label manufacturer. Naturally, this would be disposed of when the thermosensitive label is placed on the goods for sale, but would, nonetheless, identify the label before its use in the hands of the label user.

As hereinbefore mentioned, printing with conventional type of inks require drying times which otherwise slow the production of the label and interfere with the thermosensitive color-forming layer 14. These disadvantages become pronounced when such printing is done on non-porous coatings, such as the protective layer 18.

Further, it would not be possible to use an ultraviolet type setting ink in the manner used with the thermosensitive recording label 30 shown in FIG. 3 because of the limited penetration of the ultraviolet light and setting of the printed pattern.

However, with electron beam setting printing ink, the use of an electron beam enables the setting, or curing, of all of the printed patterns 20, 32, 34 occurs simultaneously because of the penetration of the electrons through the entire label 10.

It is further apparent that the electron beam source may be placed on either side of the label during the curing operation and importantly, higher densities of EB setting printing ink may be used because of the penetration of the electron beam therethrough for setting the ink. Consequently, more distinct and heavier patterns may be produced by the use of the present invention.

It should also be appreciated because of the utilization of electron beam setting ink, the printing of the patterns 20, 30, 34 may be rapidly accomplished because of the smaller amount of energy necessary to set the ink than in a comparative process and label utilizing ultraviolet setting ink. It is believed that the energy required for setting UV printing inks is about 148 $Kcal/m^2$, whereas the energy required for setting EB printing ink is about 64 $Kcal/m^2$.

The penetration of the electrons into the EB ink and the label is dependent upon the voltage accelerating the electron beam as is well known. It is expected that the penetration of electrons at 300 Kilovolts will be about 500 g/m$^2$ (or 0.5 mm), and about 1100 g/m$^2$ (1 mm), and 2000 g/m$^2$ (2 mm) at about 500 Kilovolts and 800 Kilovolts, respectively.

It should be apparent that when multiple printed patterns 20, 32, 34 are to be set simultaneously, a correspondingly higher electric voltage is necessary than when only a single printed pattern 20 is to be set. It is believed that for the setting of a single printed pattern, 165 KV electrons will be sufficient for setting.

The following example is presented by way of illustration only and is not to be considered limiting to the present invention.

EXAMPLE

A solution of leuco dye and acidic substance was prepared as follows: 20 grs. of 20% bisphenol A (acidic material) was mixed with 10 grs. of 30% calcium carbonate as a filler, 5 grs. of 20% di-isobutylene and ammonium salt of maleic acid as a binder and 5 grs. of 20% Leuco dye (3-(N,N-diethylamino) -5-methyl -7-(N, N-dibenzylamino) fluoran and 10 grs. of water.

An overcoating was prepared by mixing 10 gr. of 10% polyvinyl alcohol as a binder, 2 gr. of 25% condensation of urea-formaldehyde as a filler, 3 gr. of 12% polyamideepichlorohydrin resin, 0.5 gr. of 2% polyalkylphenoxyhydroxyethylene as a surfactant and 4.8 gr. of water.

The resulting solution was applied to a substrate consisting of high quality paper and weighing about 50 gr/m$^2$, and thereafter dried at room temperature up to about 120° C. to form a thermosensitive color-forming layer in which the solids therein amounted to about 5 gr/m$^2$. Thereafter, the overcoating was applied to the heat sensitive color-forming layer and dried at about 25–120 degree centrigrade to thereby form a protective layer over the thermosensitive color-forming layer, said protective layer having a quantity of solids of about 2 gr./m$^2$.

A pressure-sensitive acrylic copolymer emulsion adhesive layer having a denisty of about 16 g/m$^2$ to about 26 g/m$^2$ was thereafter disposed on the reverse surface of the substrate and a releasable backing sheet comprising of silicone coated substrate was adhered thereto.

EB setting type printing ink, such as Flexographic or Letter press obtained from Cabanagh or Desoto Corporation was printed in a preselected pattern onto the protective layer and thereafter subjected to a 165 Kilovolt electron beam having a beam current of about 2 mn for a period of less than one (1) second to form or set a visible printed pattern in the EB ink on the thermosensitive recording label.

After subjecting the label to conditions of 40 degree centigrade and 90% relative humidity for 24 hours, the electron beam setting printing ink pattern remained unchanged in color and density and there was no effect on the thermosensitive color-forming layer disposed thereunder, which was later printed with a thermo head to determine its usefulness.

No smearing of the EB printing ink was observed. Further, quick setting of the ink is expected to yield very high production levels with this type of labels as is not practical when ordinary solvent ink is used in printing the preselected pattern, because of slow drying time and/or heat necessary to speed the drying which causes deterioration of the thermosensitive color-forming layer.

By way of comparison to UV printing ink, the following table is presented to show the power advantage of EB printing ink setting over UV printing ink setting.

Comparison of power and Energy Requirements for Setting EB and UV ink

| Condition | UV | EB |
|---|---|---|
| Equipment | 3–10 inch Fusion Lamps | 165 KV, 2 m A 2 Mrad EB source |
| Power | 15 KW | 26 KW |
| Energy Needed | 10,320 Kcal./hr. | 17,888 Kcal./hr. |
| Production area | 69.6 m$^2$/hr. | 279 m$^2$/hr. |
| Energy per area | 148 28 Kcal./m$^2$ | 64 11 Kcal./m$^2$ |

It is apparent that the energy used by UV equipment for curing the same amount of ink is (2.3) times the energy used by EB equipment for curing EB setting printing ink.

In other words, about twice the EB printed label can be set for the same amount of power required to set UV printed label.

Although there has been described hereinabove a specific thermosensitive recording label and method for printing a thermosensitive recording label, in accordance with the present invention, for the purposes of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A thermosensitive recording label, comprising:

a substrate;

a thermosensitive color-forming layer disposed on one side of said substrate, said thermosensitive color-forming layer comprising a colorless or light-colored leuco dye and an acidic substance capable of causing said leuco dye to undergo color formation upon heating of the thermosensitive recording label;

a protective layer disposed on said thermosensitive color-forming layer;

electron beam setting printing ink disposed in a preselected pattern on said protective layer;

a pressure-sensitive adhesive layer disposed on another side of said substrate;

a releasable backing sheet disposed on said pressure-sensitive adhesive layer; and, electron beam setting printing ink disposed in a preselected pattern on said releasable backing sheet, said electron beam setting printing ink consisting essentially of a prepolymer, a monomer and a pigment, said prepolymer being a member of the group comprising unsaturated polyesters, vinyloxyethylacrylate, urethane-acrylates, epoxy-acrylates, and dicyclopentadiene acrylates, said monomer being a member of the group comprising acrylic acid esters, methacrylic acid esters, aryl compounds and styrene;

said electron beam setting printing ink having sufficient density and thickness to enable an observable pattern to appeal upon setting of the electron beam setting printing ink during exposure to an electron beam.

2. The thermosensitive recording label according to claim 1, wherein said thermosensitive color-forming layer has a density and thickness such that insufficient heat is deposited therein during setting of the electron beam setting printing ink to cause color formation.

3. A thermosensitive recording label, comprising:

a substrate;

a thermosensitive color-forming layer disposed on one side of said substrate, said thermosensitive color-forming layer comprising a colorless or light-colored leuco dye and an acidic substance capable of causing said leuco dye to undergo color formation upon heating of the thermosensitive recording label;

a protective layer disposed on said thermosensitive color-forming layer;

electron beam setting printing ink disposed in a preselected pattern on said protective layer;

a pressure-sensitive adhesive layer disposed on another side of said substrate;

a releasable backing sheet disposed on said pressure-sensitive adhesive layer; and, electron beam setting printing ink disposed in a preselected pattern on said releasable backing sheet, said electron beam setting printing ink consisting essentially of a prepolymer, a monomer and a pigment, the combined thickness of the substrate, the thermosensitive color-forming layer, the protective layer, the pressure-sensitive adhesive layer, and the releasable backing sheet being such that the electon beam setting printing ink disposed on said protective layer and the electron beam setting printing ink disposed on said releasable backing sheet can be simultaneously set be a single electron beam source disposed proximate either side of the thermosensitive recording label.

4. The thermosensitive recording label according to claim 3, wherein said electron beam setting printing ink consists essentially of a prepolymer, a monomer and a pigment.

5. The thermosensitive recording label according to claim 4, wherein the substrate comprises paper having a density of about 50 g/m$^2$ to about 58 g/m$^2$, the thermosensitive color-forming layer has a density of about 4 g/m$^2$ to about 10 g/m$^2$, the protective layer comprises polyvinyl alcohol having a density of about 0.5 g/m$^2$, to about 4 g/m$^2$, the pressure sensitive adhesive layer comprises acrylic copolymer emulsion having a density of about 16 g/m$^2$ to about 26 g/m$^2$ and the releasable backing sheet is comprised of paper having a density of about 65 g/m$^2$ to about 73 g/m$^2$.

6. The thermosensitive recording label according to claim 5, wherein the thickness of the substrate is about 65 μm to about 70 μm, the thickness of the thermosensitive color-forming layer is about 10 μm to about 20 μm, the thickness of the protective layer is about 1 μm to about 10 μm, the thickness of the pressure-sensitive adhesive layer is about 15 μm to 25 μm, and the thickness of the releasable backing sheet is about 62 μm to about 72 μm.

7. The thermosensitive recording label according to claim 6, wherein the thickness of said electron beam setting printing ink is about 0.1 μm to about 15 μm.

8. The thermosensitive recording label according to claim 7, wherein the electron beam setting printing ink is capable of being set at most 64 Kcal/m$^2$ of electron beam energy.

9. The thermosensitive recording label according to claim 8, wherein the protective layer consists of a water-soluble resin.

10. The thermosensitive recording label according to claim 9, wherein the prepolymer is a member of the group comprising unsaturated polyesters, vinyloxyethylacrylate, urethane-acrylates, epoxy-acrylates and dicyclopentadiene acrylates, and the monomer is a member of the group comprising acrylic acid esters, methacrylic acid esters, aryl compounds and styrene.

* * * * *